US009053662B2

(12) United States Patent
Hsu et al.

(10) Patent No.: US 9,053,662 B2
(45) Date of Patent: Jun. 9, 2015

(54) METHOD FOR ADJUSTING UNIFORMITY OF A DISPLAY PANEL AND ASSOCIATED DISPLAY CONTROLLER

(75) Inventors: Te-Wei Hsu, New Taipei (TW); Tung-Han Sung, New Taipei (TW); Chuan-Tsung Chen, Taoyuan County (TW)

(73) Assignee: MSTAR SEMICONDUCTOR, INC., Hsinchu County (TW)

( * ) Notice: Subject to any disclaimer, the term of this patent is extended or adjusted under 35 U.S.C. 154(b) by 611 days.

(21) Appl. No.: 13/292,213

(22) Filed: Nov. 9, 2011

(65) Prior Publication Data

US 2013/0033526 A1 Feb. 7, 2013

(30) Foreign Application Priority Data

Aug. 2, 2011 (TW) ..... 100127469 A

(51) Int. Cl.
*G09G 5/10* (2006.01)
*G09G 3/20* (2006.01)
*G09G 3/00* (2006.01)

(52) U.S. Cl.
CPC ..... *G09G 3/2003* (2013.01); *G09G 3/006* (2013.01); *G09G 2320/0233* (2013.01); *G09G 2320/0242* (2013.01); *G09G 2320/0666* (2013.01); *G09G 2320/0693* (2013.01)

(58) Field of Classification Search
CPC ..... G09G 2320/0276; G09G 2360/16; G09G 2320/0626
USPC ..... 345/102, 600, 601, 690, 694
See application file for complete search history.

(56) References Cited

U.S. PATENT DOCUMENTS

| | | | | |
|---|---|---|---|---|
| 2005/0099429 | A1* | 5/2005 | Chen et al. | 345/589 |
| 2005/0099431 | A1* | 5/2005 | Herbert et al. | 345/601 |
| 2006/0221047 | A1* | 10/2006 | Tanizoe et al. | 345/102 |
| 2007/0091114 | A1* | 4/2007 | Kwak et al. | 345/600 |
| 2007/0132784 | A1* | 6/2007 | Easwar et al. | 345/629 |
| 2008/0112164 | A1* | 5/2008 | Teshirogi | 362/231 |
| 2010/0259555 | A1* | 10/2010 | Hibi et al. | 345/601 |
| 2011/0227941 | A1* | 9/2011 | Huang | 345/596 |
| 2011/0285763 | A1* | 11/2011 | Bassi et al. | 345/694 |

FOREIGN PATENT DOCUMENTS

| | | |
|---|---|---|
| TW | 200834497 A | 8/2008 |
| TW | 201106333 A | 2/2011 |

OTHER PUBLICATIONS

Taiwan Patent Office, "Office Action", Nov. 12, 2013.

* cited by examiner

*Primary Examiner* — Jonathan Blancha
(74) *Attorney, Agent, or Firm* — WPAT, PC; Justin King

(57) ABSTRACT

A method for adjusting a uniformity of a panel is provided. The panel includes a plurality of blocks. The method includes: comparing whether a color display component of each of the blocks in response to a first input value matches a target component, comparing whether a color characteristic value of each of the blocks in response to a second input value matches a target characteristic value, and providing a corresponding modified second input component and a modified third input component for each of the blocks. The target component is determined according to a plurality of main display components of a plurality of display values corresponding to the blocks, and the target characteristic value is determined according to the plurality of color characteristic values corresponding to the blocks.

17 Claims, 4 Drawing Sheets

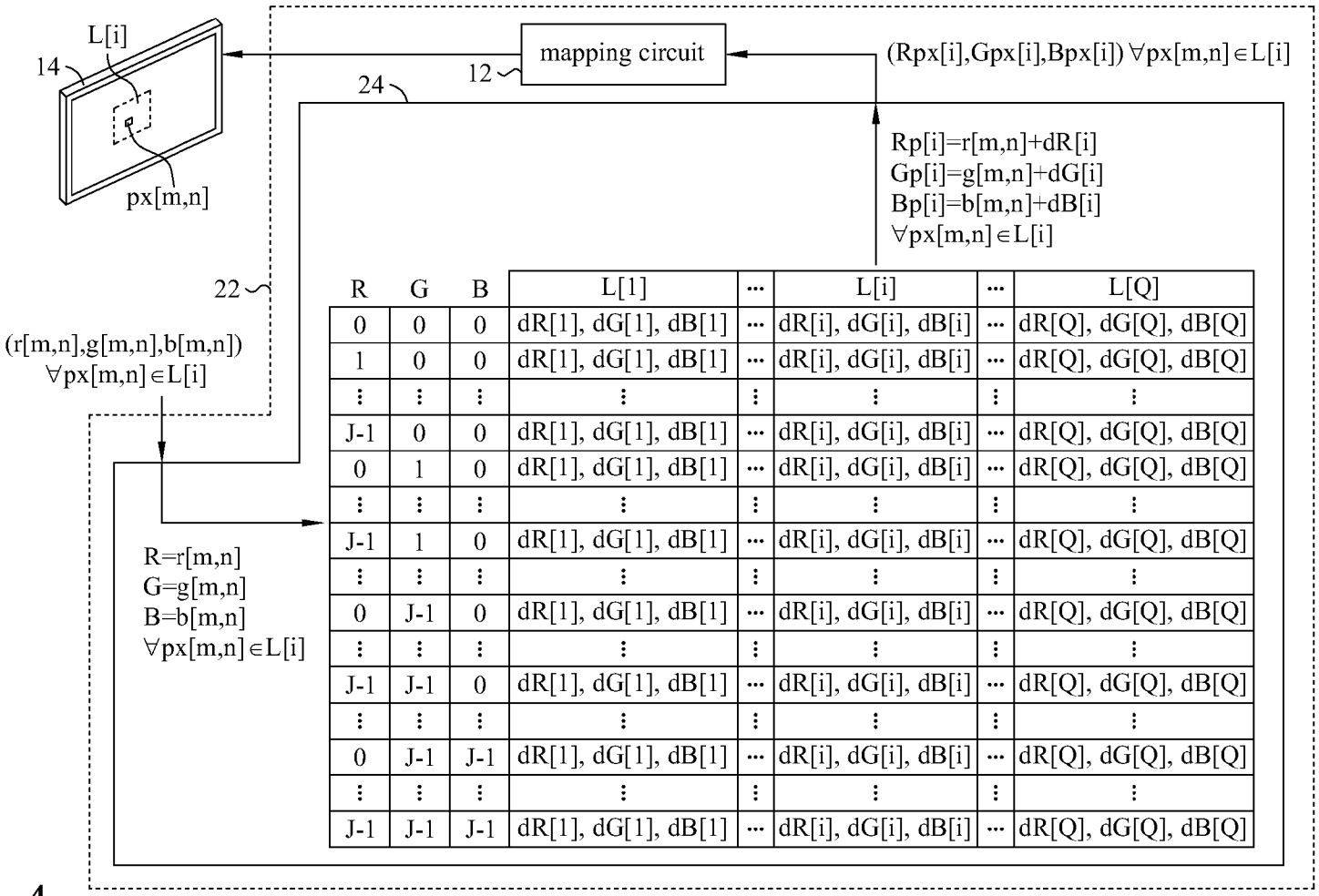
(Rpx[i],Gpx[i],Bpx[i]) ∀px[m,n]∈L[i]
mapping circuit
12
24
Rp[i]=r[m,n]+dR[i]
Gp[i]=g[m,n]+dG[i]
Bp[i]=b[m,n]+dB[i]
∀px[m,n]∈L[i]
R G B L[1] ... L[i] ... L[Q]
0 0 0 dR[1], dG[1], dB[1] ... dR[i], dG[i], dB[i] ... dR[Q], dG[Q], dB[Q]
1 0 0 dR[1], dG[1], dB[1] ... dR[i], dG[i], dB[i] ... dR[Q], dG[Q], dB[Q]
... ... ...

METHOD FOR ADJUSTING UNIFORMITY OF A DISPLAY PANEL AND ASSOCIATED DISPLAY CONTROLLER

This application claims the benefit of Taiwan application Serial No. 100127469, filed Aug. 2, 2011, the subject matter of which is incorporated herein by reference.

BACKGROUND OF THE INVENTION

1. Field of the Invention

The invention relates in general to a method for adjusting the uniformity of a panel and associated display controller, and more particularly, to a method for adjusting brightness and uniformity of colors displayed on a panel and associated display controller.

2. Description of the Related Art

Display panels, e.g., color liquid crystal display (LCD) panels for monitors and televisions, being capable of presenting diversified multimedia information, are prevalent in the modern information society.

A panel comprises a plurality of pixels that are driven and controlled to display by a display controller (e.g., a control chip). The display controller receives from a signal source a video stream comprising a series of input values, each corresponding to a particular pixel. The display controller then controls the pixels to display corresponding colors according to the input values of the pixels. For example, each of the input value (r_in, g_in, b_in) comprises three input components, a red component r_in, a green component g_in, and a blue component b_in. A value of each of the input components is between a bottom component value 0 and a top component value (J-1) and may thus have J number of possible candidate values. That is to say, based on various combinations of input components, the input value (r_in, g_in, b_in) may have J*J*J number of possible candidate values for respectively describing J*J*J number of colors of the pixels displayed on the display.

However, due to various factors associated with a panel, e.g., unevenness of backlight, assembly errors, and different degrees of manufacturing drifts on pixels at different positions, colors displayed by pixels at different positions of the panel may still be different even when a same input value is inputted to all of the pixels of the same panel. As a result, the panel may fail to consistently display a uniform color at different regions of the panel.

The uniformity of colors displayed on a panel may be measured by a color meter. For example, a panel may be divided into a plurality of blocks, e.g., 9 or 25 blocks, and colors displayed at positions of the blocks are respectively measured by the color meter to obtain a display value (X, Y, Z) for the block. The display value comprises three display components X, Y, and Z, each of which has three primary color components R, G, and B. Out of the three display components X, Y, and Z, only the display component Y is associated with luma and is regarded as a main display component, and the display components X and Z are regarded as two auxiliary display components. By combining the display components X, Y, and Z, a color characteristic value, e.g., a color temperature or chroma, may be calculated. When each of the pixels receives a same input value, a color output uniformity is then quantitatively estimated by comparing brightness and/or color characteristic values of a panel. More specifically, uniformity reduces as differences between brightness and/or color characteristic values of different blocks get larger.

A panel with unsatisfactory uniformity is incapable of correctly displaying video to significantly impose desirable effects on a quality presented by the panel.

SUMMARY OF THE INVENTION

The invention relates to a technique for adjusting a uniformity of a display panel to overcome the drawback associated with the prior art. In the present invention, a panel is divided into a plurality of blocks. A plurality of display values corresponding to the blocks in response to one of a plurality of candidate input values displayed by the panel are first obtained. The plurality of display values are then adjusted with a digital compensation mechanism to provide a plurality of modified input values in a unit of blocks. Through distribution or repetitively performing the compensation mechanism on different candidate input values, modified input values corresponding to the plurality of candidate input values in a unit of blocks are obtained. The plurality of modified input values may further be distributed to provide a plurality of modified pixel values in a unit of pixels. For example, when pixels of a single panel are to respond to a same input value, a modified input value is respectively provided to each of the pixels according to a block where each of the pixels is located, and the modified input value is replaced by the modified pixel value during distribution. Thus, the pixels in different blocks display colors according to different modified pixel input values so that brightness and characteristics of colors displayed by different blocks may appear consistent across each block, as well as the entire display panel.

According to an embodiment of the present invention, a method for adjusting a uniformity of a panel is provided. The panel comprises a plurality of blocks L[1] to L[Q]. Each of the blocks L[i] associates a first input value (0, G, 0) comprising a first input component (green input component) G to a display value (GX[i], GY[i], GZ[i]) via a measurement. A main display component (e.g., brightness) GY[i] in each of the blocks L[i] is adjusted to match a target component GYtarget, and a corresponding adjusted first input component Gp[i] is provided for each of the blocks L[i] accordingly. An input component of a second input (R, Gp[i], B) is associated to a color characteristic value (e.g., color temperature) CCT[i]. The color characteristic value CCT[i] of each of the blocks L[i] is adjusted under the premise that Gp[i] of the second input (R, Gp[i], B) is fixed to match a target characteristic value CCTtarget, and a corresponding modified second input component Rp[i] and a modified third input component Bp[i] are provided for each of the blocks L[i] accordingly. That is, for a first input component (green input component) G, a second input component (red input component) R, and a third input component (blue input component) B, the present invention provides a corresponding modified second input component (red input component) Rp[i], modified first input component (green input component) Gp[i], and modified third input component (blue input component) Bp[i].

In other words, for each of the blocks L[i], the first input component (green input component) G of the first input value (0, G, 0) is modified to generate the modified first input component (green input component) Gp[i] to provide a modified first input value (0, Gp[i], 0). The modified first input value (0, Gp[i], 0) associates with a modified display value (GXp[i], GYp[i], GZp[i]) via a color display, with the main display component GYp[i] matching the target component GYtarget. That is, in the present invention, the modified first input component Gp[i] is provided to achieve a goal of "uniform/matching main display components GYp[i] of all of the blocks L[i]", wherein a "matching" of main display components for two blocks means the main display components for the two blocks are equal and/or has a difference smaller than a predetermined value.

For each of the blocks L[i], the second input component (red input component) R and the third input component (blue input component) B of the second input value (R, Gp[i], B) are respectively replaced by the modified second input component (red input component) Rp[i] and the modified third input component (blue input component) Bp[i], forming a modified second input value (Rp[i], Gp[i], Bp[i]). Via the color display, the block L[i] associates the modified second input value (Rp[i], Gp[i], Bp[i]) to the modified color characteristic value CCT[i], which matches the target characteristic value CCTtarget. That is, in the present invention, the modified second input component Rp[i] and the modified third input component Bp[i] are provided to achieve a goal of "uniform/matching (modified) color characteristic CCT[i] of all of the blocks L[i]", generating modified second input values for the blocks which are associated with a modified color characteristic value consistent among all the blocks.

According to an embodiment of the present invention, the method updates the first input component (green input component) G of the first input value (0, G, 0) to provide a corresponding modified first input value (0, Gp[i], 0) for each of the blocks L[i]. Via the color display of the block L[i], the modified first input value (0, Gp[i], 0) is associated to the modified display value (GXp[i], GYp[i], BYp[i]). For each of the blocks L[i], the main display component GYp[i] of the modified display value (GXp[i], GYp[i], BYp[i]) is compared with the target component GYtarget to determine whether it matches the target component GYtarget, so as to repeatedly update the first input component (green input component) Gp[i] to identify the modified first input component (green input component) Gp[i] corresponding to the main display component GYp[i] that matches the target component GYtarget.

Similarly, for each of the blocks L[i], the second input component (red input component) R and/or the third input component (blue input component) B of the second input value (R, Gp[i], B) are updated to generate the corresponding modified second input value (Rp[i], Gp[i], Bp[i]). Via the color display of the block L[i], the modified second input value (Rp[i], Gp[i], Bp[i]) is associated to the modified color characteristic value CCT[i]. For each of the block L[i], the modified color characteristic value CCT[i] is compared to the target characteristic value CCTtarget to determine whether it suitably matches the target characteristic value CCTtarget, so as to repeatedly update the second input component (red input component) Rp[i] and the third input component (blue input component) Bp[i] to identify the modified second input component (red input component) Rp[i] and the modified third input component (blue input component) Bp[i] corresponding to the modified color characteristic value CCT[i] that matches the target characteristic value CCTtarget.

According to an embodiment of the present invention, the target component GYtarget is determined according to the main display components GY[1] to GY[Q] corresponding to the blocks L[1] to L[Q]. For example, the target component GYtarget may be min(GY[1], . . . , GY[Q]), max (GY[1], . . . , GY[Q]), or mean(GY[1], . . . , GY[Q]), where min( ) max( ) and mean( ) respectively represent a minimum value, a maximum value and a mean value of a set of input components. The target value GYtarget may be no greater than the main display components GY[1] to GY[Q] corresponding to all of the blocks.

Similarly, the target characteristic value CCTtarget may also be determined according to the color characteristic values CCT[1] to CCT[Q] corresponding to the blocks L[1] to L[Q]. For example, the target color characteristic value CCTtarget may be min(CCT[1], . . . , CCT[Q]), max (CCT[1], . . . , CCT[Q]), or mean(CCT[1], . . . , CCT[Q]).

In the present invention, the plurality of modified second input values (Rp[i], Gp[i], Bp[i]) corresponding to the blocks L[i] are obtained and distributed to the pixels, so as to provide a plurality of modified pixel input values (Rpx[i], Gpx[i], Bpx[i]) in a unit of pixels.

According to another embodiment of the present invention, a display controller for a panel is provided. The display controller comprises a modifying module and a mapping circuit. The panel comprises a plurality of blocks L[1] to L[Q], each of which comprises a plurality of pixels px[m, n]. The display controller receives an input value (r[m, n], g[m, n], b[m, n]) of the pixel px[m, n] to display corresponding colors. Each of the input values (r[m, n], g[m, n], b[m, n]) represents one (represented by Rc, Gc, Bc) of a plurality of candidate input values. For example, the input value (R, 0, 0) may have J number (e.g., 256) of possible candidate input values (0, 0, 0), (1, 0, 0), (2, 0, 0) to (J-1, 0, 0). Thus, there are J*J*J number of possible candidate values for respectively describing J*J*J number of colors for each particular pixel.

The modifying module of the display controller provides a corresponding modified candidate input value (Rp[i], Gp[i], Bp[i]) for each of the blocks L[i] with respect to each of the candidate input values (Rc, Gc, Bc), and provides a corresponding modified input value (Rp[i], Gp[i], Bp[i]) for each of the pixels px[m, n] according to the block L[i] where the pixel p[m, n] is located and the input value (r[m, n], g[m, n], b[m, n]) of the pixel p[m, n]. The mapping circuit enables each of the pixels px[m, n] to display colors according to the modified input value (Rp[i], Gp[i], Bp[i]), or distributes the modified input value (Rp[i], Gp[i], Bp[i]) using approaches such as linear distribution or alpha-blending to the pixels so that each of the pixels px[m, n] displays colors according to the modified pixel input value (Rpx[i], Gpx[i], Bpx[i]).

In each of the modified candidate input values (Rp[i], Gp[i], Bp[i]), the monochromatic modified first input value (0, Gp[i], 0) of each of the blocks L[i] allows the main display components GY[1] to GY[Q] of colors displayed by the blocks L[1] to L[Q] to match with one another; the modified candidate input value (Rp[i], Gp[i], Bp[i]) of each of the blocks L[i] allows the color characteristic values CCT[1] to CCT[Q] of the colors displayed by the blocks L[1] to L[Q] to match with one another.

The above and other aspects of the invention will become better understood with regard to the following detailed description of the preferred but non-limiting embodiments. The following description is made with reference to the accompanying drawings.

BRIEF DESCRIPTION OF THE DRAWINGS

FIG. 4 is a schematic diagram of a display controller according to an embodiment of the present invention.

DETAILED DESCRIPTION OF THE INVENTION

Figure 1:
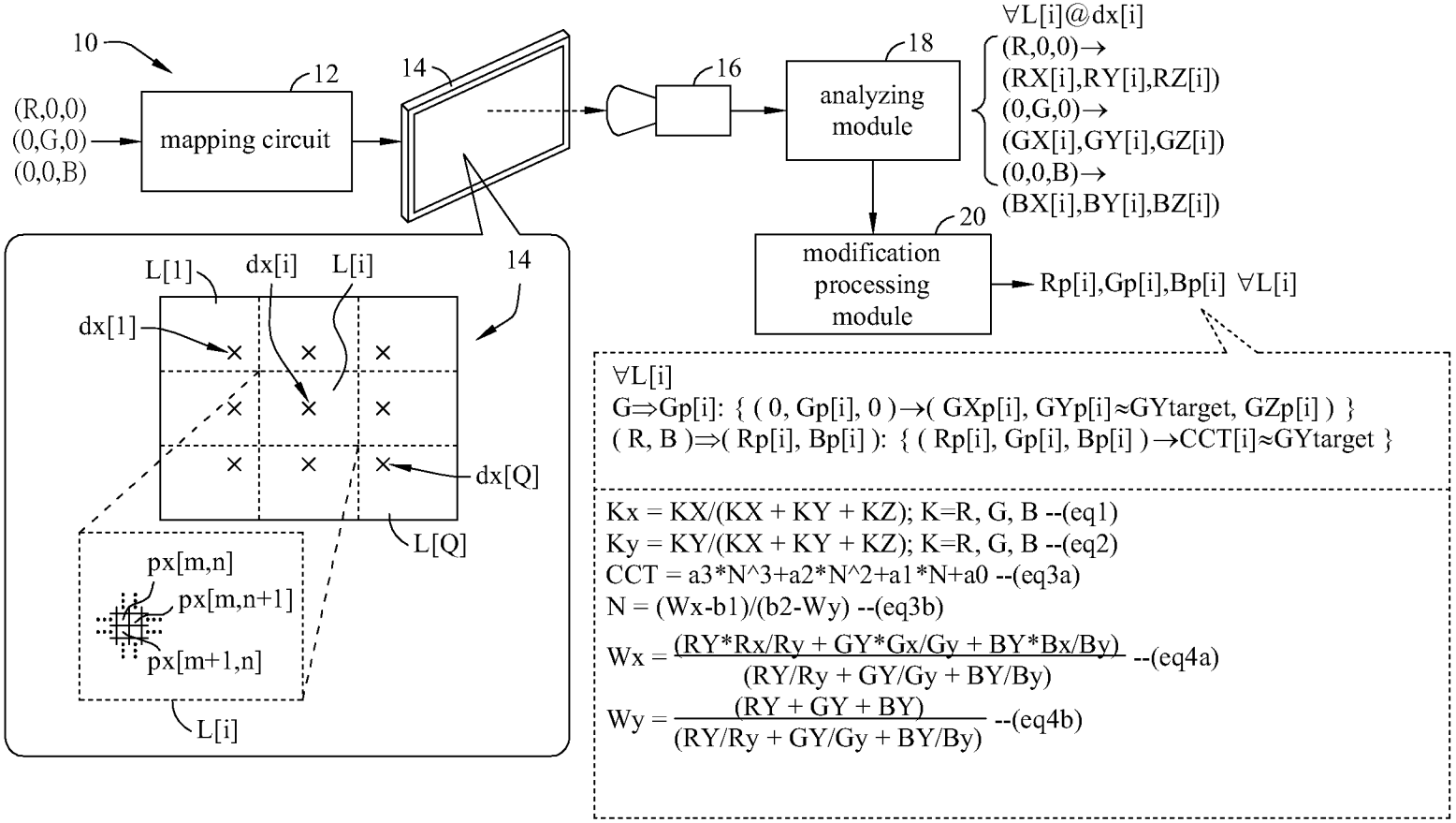
FIG. 1 is a schematic diagram of a modifying system according to an embodiment of the present invention.

FIG. 1 shows a modifying system 10 according to an embodiment of the present invention. The modifying system 10 is for adjusting a uniformity of a panel 14 (e.g., a display panel) by implementing the technique disclosed in the present invention. The panel 14 cooperates with a mapping circuit 12. The modifying system 10 comprises a color meter 16, an analyzing module 18, and a modification processing module 20. A display region of the panel 14 is divided into Q blocks L[1] to L[Q], and each of the blocks L[i] (where i=1 to Q) comprises a plurality of pixels, e.g., pixels px[m, n], px[m+1, n] and px[m, n+1]. Each particular pixel of the panel may be referenced by using these labels in a designation, for example, L[Q]px[m,n]. The mapping circuit 12 enables the pixels of the panel 14 to display corresponding colors according to input values of the pixels. At least one corresponding measurement position dx[i] is defined in each of the blocks L[i], with a number of the measurement position dx[i] having a maximum number as a number of all pixels encompassed in the block or being a predetermined number for sampling. When all the pixels of the panel 14 receive a same input value, the color meter 16 measures at the positions dx[i] to obtain a display value of colors displayed by each of the blocks L[i]. However, means for obtaining the display value of the block L[i] is not limited to measuring at all of the positions dx[i]. For example, a measurement position dx[S] corresponding a specific predetermined block L[S] on the panel 14 is measured, and a brightness distribution graph of the panel 14 is rendered through means of photographing to obtain a display value corresponding to each of the blocks L[i] according to a ratio of the brightness distribution. The input value generally consists of three primary colors, e.g., (RGB), and thus a measured display value corresponding to the block L[i] by the color meter 16 is:

$$\begin{bmatrix} RX[i], & RY[i], & RZ[i] \\ GX[i], & GY[i], & GZ[i] \\ BX[i], & BY[i], & BZ[i] \end{bmatrix}$$

It can be seen from the above that, in one embodiment, when the input value is (R, 0, 0), the display value corresponding to the block L[i] measured at the position dx[i] by the color meter 16 is (RX[i], RY[i], RZ[i]); when the input value is (0, G, 0), the display value corresponding to the block L[i] measured by the color meter 16 is (GX[i], GY[i], GZ[i]); when the input value is (0, 0, B), the display value corresponding to the block L[i] measured by the color meter 16 is (BX[i], BY[i], BZ[i]). However, due to inconsistency of the panel 14, the display value of different blocks L[i] may differ even though input values for the blocks L[i] are the same. For example, even when the pixels of the blocks L[i] are provided with a same input value (0, G, 0), display components GY[i1] and GY[i2] (where i1 differs from i2) may still have different values.

According to measurements of the color meter 16, the analyzing module 18 provides corresponding block color display values for the candidate input values. For example, the input value (R, 0, 0) may have J number (such as 256) of possible input values (0, 0, 0), (1, 0, 0), (2, 0, 0) to (J-1, 0, 0). The analyzing module 18 provides J number of corresponding display values (RX[i], RY[i], RZ[i]) for each of the blocks L[i] according to measurements of the color meter 16. It should be noted that, it is not necessary for color meter 16 to change the input value (R, 0, 0) in each of the blocks L[i] J number of times to obtain the J number of display values. For example, the color meter 16 only measures several numbers of candidate input values (less then J times), and respectively obtains the J number of display values corresponding to the J number of candidate input values by performing operations, such as interpolation, on the measured result. Similarly, the analyzing module 18 provides J number of corresponding display values (GX[i], GY[i], GZ[i]) for each of the blocks L[i] for the J number of candidate input values of the input value (0, G, 0), and provides J number of corresponding display values (BX[i], BY[i], BZ[i]) for each of the blocks L[i] for the J number of candidate input values of the input value (0, 0, B).

To compensate for inconsistency of the panel 14, after acquiring uniformity of brightness and uniformity of color characteristic values (e.g., color temperature), the modification processing module 20 provides modified input components Rp[i], Gp[i], and Bp[i] for each of the blocks L[i] with respect to the input components R, G, and B of the input value, respectively. Thus, when a predetermined pixel px[m, n] in the block L[i] originally displays colors according to the input value (R, G, B), the input value (R, G, B) is now replaced by the modified input value (Rp[i], Gp[i], Bp[i]), so that the pixel px[m, n] displays colors according to the modified input value (Rp[i], Gp[i], Bp[i]). In addition, the modification processing module 20 may further respectively process the modified input value (Rp[i], Gp[i], Bp[i]) corresponding to each of the blocks L[i] by linear distribution or alpha-blending, to obtain a plurality of modified pixel input values (Rpx[i], Gpx[i], Bpx[i]) for each of the pixels px[m, n], so that the pixel px[m, n] displays colors according to the modified pixel input value (Rpx[i], Gpx[i], Bpx[i]). The modified pixel input value (Rpx[i], Gpx[i], Bpx[i]) is obtained by processing the modified input value (Rp[i], Gp[i], Bp[i]), which is designed for uniform brightness and uniform color characteristic values of the entire panel. Therefore, the uniformity of color rendering of the panel 14 is also enhanced when the pixel px[m, n] displays colors according to the modified pixel input value (Rpx[i], Gpx[i], Bpx[i]).

The modified input value (Rp[i], Gp[i], Bp[i]) corresponding to each of the blocks L[i] is synthesized from the input values (Rp[i], 0, 0), (0, Gp[i], 0), and (0, 0, Bp[i]). As such, the main display component GYp[i] of the display value (GXp[i], GYp[i], GZp[i]) corresponding to the input value (0, Gp[i], 0), matches a constant target GYtarget. For example, when all of the pixels of the panel 14 are to display according to the same input value (0, G, 0), since colors of the display value (GXp[i], GYp[i], GZp[i]) are presented after the input value (0, G, 0) is replaced by the corresponding modified input value (0, Gp[i], 0) in each of the blocks L[i], the main display components GYp[1] to GYp[Q] displayed in the blocks L[1] to L[Q] uniformly approximate the target component GYtarget. Due to the fact that the brightness of each of the blocks L[i] is dominated by the main display component GYp[i], the brightness uniformity of the panel 14 is enhanced by an even distribution of the main display components GYp[i].

Furthermore, in a display value (RXp[i]+GXp[i]+BXp[i], RYp[i]+GYp[i]+BYp[i], RZp[i]+GZp[i]+BZp[i]) corresponding to the modified input value (Rp[i], Gp[i], Bp[i]), the color characteristic value CCT[i] calculated from the display components RXp[i], GXp[i], BXp[i], RYp[i], GYp[i], BYp[i], RZp[i], GZp[i], and BZp[i] matches a constant target characteristic value CCTtarget. That is to say, when all of the pixels of the panel 14 are to display according to the same input value (R, G, B), since colors of the display value (RXp[i]+GXp[i]+BXp[i], RYp[i]+GYp[i]+BYp[i], RZp[i]+GZp[i]+BZp[i]) are presented after the input value (R, G, B) is replaced by the corresponding modified input value (Rp[i], Gp[i], Bp[i]) in each of the blocks L[i], the color characteristic values CCT[1] to CCT[Q] displayed in the blocks L[1] to L[Q] uniformly approximate the target characteristic value CCTtarget, so that the uniformity of the color characteristic values of the panel 14 is enhanced.

Referring to FIG. 1, equations eq1, eq2, eq3a, eq3b, eq4a, and eq4b describe how a corresponding color characteristic value is calculated from display components RX, RY, RZ, GX, GY, GZ, BX, BY, and BZ of a display value. From equations eq1 and eq2, display components Rx, Gx, Bx, Ry, Gy, and By are obtained. For example, Rx=RX/(RX+RY+RZ) and Bx=BX/(BX+BY+BZ). According to the display components RX, RY, RZ, GX, GY, GZ, BX, BY, and BZ, and the display components Rx, Gx, Bx, Ry, Gy and By obtained from the equations eq1 and eq2, display components Wx and Wy are obtained from the equations eq4a and eq4b. A reference value N is further obtained from the equation eq3b, where coefficients b1 and b2 in equation eq3b are constants respectively equal to 0.332 and 0.1858. The color characteristic value CCT is obtained according to the equation eq3a, where coefficients a3, a2, a1, and a0 in the equation eq3a are also constants respectively equal to 437, 3601, 6851, and 5517. According to the above equations, the color characteristic value CCT[i] corresponding to the modified input value (Rp[i], Gp[i], Bp[i]) may be calculated. That is, by respectively substituting the display components RXp[i], GXp[i], BXp[i], RYp[i], GYp[i], BYp[i], RZp[i], GZp[i], and BZp[i] corresponding to the modified input value as the display components RX, GX, BX, RY, GY, BY, RZ, GZ, and BZ into the equations eq1, eq2, eq3a, eq3b, eq4a, and eq4b, the color characteristic value CCt[i] corresponding to the modified input value (Rp[i], Gp[i], Bp[i]) may be obtained.

Figure 2:
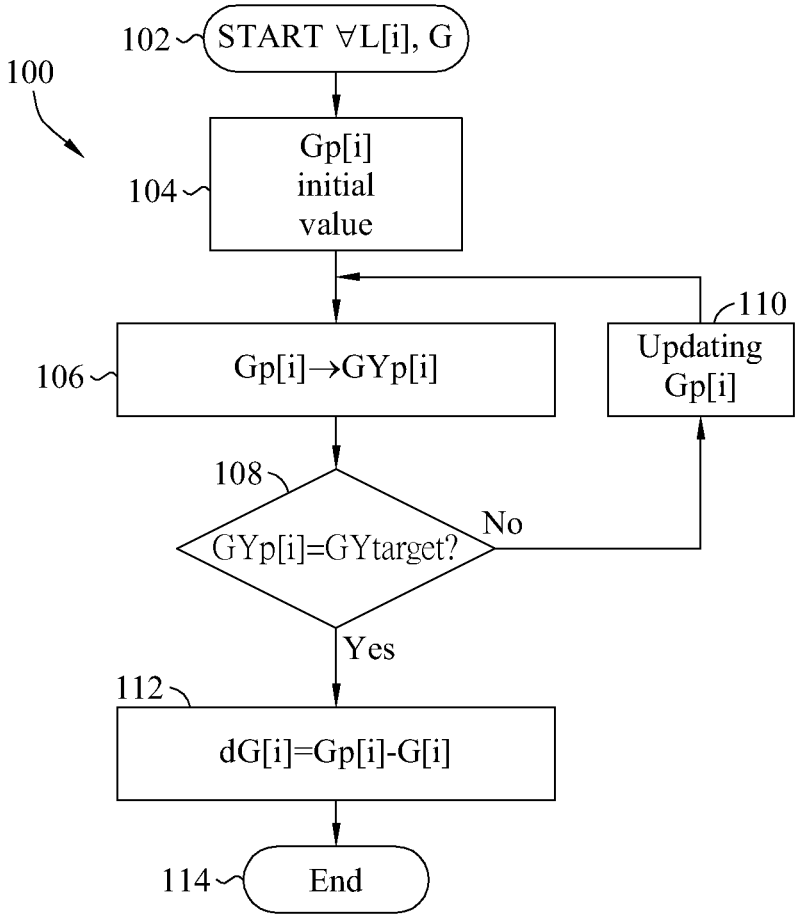
FIG. 2 is a flowchart of a flow for providing a modified first input component according to an embodiment of the present invention.
Figure 3:
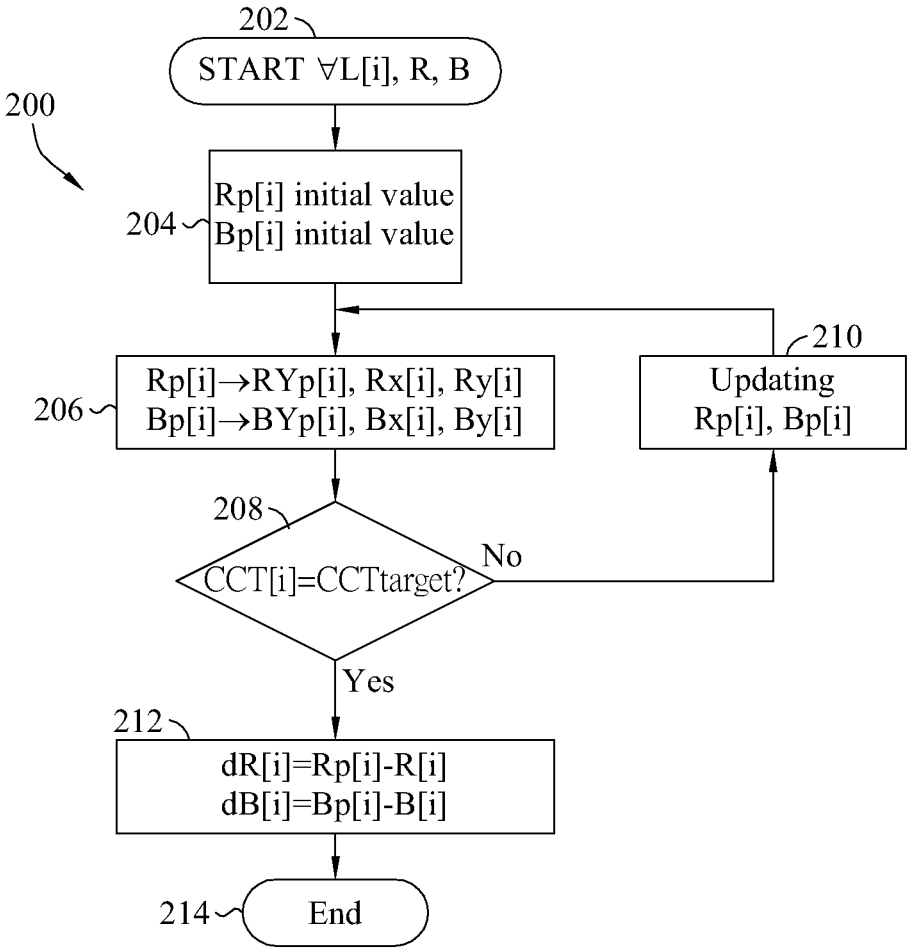
FIG. 3 is a flowchart of a flow for providing a modified second input component and a modified third input component according to an embodiment of the present invention.

The technique for providing the modified input value (Rp[i], Gp[i], Bp[i]) for each of the blocks L[i] according to the input value (R, G, B) are illustrated with reference to FIG. 2 and FIG. 3. FIG. 2 shows a flowchart of a process 100 for obtaining a modified input component Gp[i] according to an embodiment of the present invention. FIG. 3 shows a flowchart of a process 200 for obtaining modified input values Rp[i] and Bp[i] according to an embodiment of the present invention. The process 100 applicable to the modifying system 100 in FIG. 1 shall be described below.

In Step 102, the process 100 begins with a predetermined candidate value of an input component G and a predetermined block L[i] to provide a modified input component Gp[i] for replacing the input component G for the block L[i].

In Step 104, an initial value of the modified input component Gp[i] is determined. For example, the initial value of the modified input component Gp[i] may equal to the input component G.

In Step 106, a modified main display component GYp[i] corresponding to the modified input component Gp[i] is obtained. As described with reference to FIG. 1, the analyzing module 18 provides a corresponding block color display value (GX[i], GY[i], GZ[i]) for each candidate input value of an input value (0, G, 0). The modified main display component GYp[i] corresponding to the modified input component Gp[i] is then the display component GY[i] corresponding to the block L[i] when the input value (0, G, 0) equals (0, Gp[i], 0).

In Step 108, the modified main display component GYp[i] corresponding to the modified input component Gp[i] is compared with a target component GYtarget to determine whether the modified main display component GYp[i] matches the target component GYtarget. Step 112 is performed when a result is affirmative (indicating GYp[i] matches target component GYtarget), or else Step 110 is performed.

In Step 110, the value of the modified input component Gp[i] is updated, and Step 106 is iterated until GYp[i] matches target component GYtarget. For example, when the modified main display component GYp[i] corresponding to the modified input component Gp[i] is greater than the target component GYtarget, the value of the modified input component Gp[i] is decreased. Conversely, when the modified main display component GYp[i] corresponding to the modified input component Gp[i] is smaller than the target component GYtarget, the value of the modified input component Gp[i] may be increased.

When the process 100 reaches Step 112, it infers that the modified main input component GYp[i] corresponding to the modified input component GY[i] matches the target component GYtarget. Therefore, in Step 112, the corresponding modified input component Gp[i] of the predetermined candidate input component G is provided to the block L[i]. Furthermore, a modification difference dG[i] between the modified input component Gp[i] and the input component G may be calculated.

The process 100 ends in Step 114.

The process 100 may be repetitively performed for different blocks L[1] to L[Q] and the input component G of different candidate values (e.g., 0 to (J-1)). For example, the process 100 is performed for Q*J number of times to respectively provide J number of corresponding modified input components Gp[i] for the blocks L[1] to L[Q] with respect to J number of possible input component G. In equivalence, providing the J number of corresponding modified input components Gp[i] equals to providing J number of corresponding modification differences dG[i].

Before the process 100 begins, a target component GYtarget may be determined. For example, to execute the process 100 for each of the blocks L[i] with respect to a predetermined input component G, the target component GYtarget may be no greater than each of the display components GY[1] to GY[Q] corresponding to the input component G of the blocks L[1] to L[Q]. In an embodiment, the target component GYtarget may be min(GY[1], . . . , GY[Q]). For example, when the value of the input component G equals a top component value (J-1), the target component GYtarget may be set to a minimum value in the display components GY[1] to GY[Q]. Furthermore, the target component GYtarget may also be max (GY[1], . . . , GY[Q]). For example, when the value of the input component G equals a bottom component value 0, the target component GYtarget may be set to a maximum value in the display components GY[1] to GY[Q]. Alternatively, the target component GYtarget may also be mean(GY[1], . . . , GY[Q]).

FIG. 3 shows a flowchart of a process 200 also applicable to the modifying system 100 in FIG. 1.

In Step 202, the process 200 begins with a predetermined candidate value of an input component R, a predetermined candidate value of an input component G, a predetermined candidate value of an input component B, and a predetermined block L[i] to provide a modified input component Rp[i] and a modified input component Bp[i] for respectively replacing the input components R and B. The input component G may be replaced by the modified input component Gp[i] obtained from the process 100.

In Step 204, initial values of the modified input components Rp[i] and Bp[i] are determined. For example, the initial value of the modified input component Rp[i] may equal to the input component R, and the initial value of the modified input component Bp[i] may equal to the input component B.

In Step 206, a color modification value CCT[i] corresponding to the modified input components Rp[i] and Bp[i] is obtained. As previously described with reference to FIG. 1, the analyzing module 18 provides modified display values (RXp[i], RYp[i], RZp[i]), (GXp[i], GYp[i], GZp[i]), and (BXp[i], BYp[i], BZp[i]) corresponding to the modified input components Rp[i], Gp[i], and Bp[i] for each of the blocks L[i]. For example, the modified display components RXp[i], RYp[i], and RZp[i] corresponding to the input components Rp[i] are display components RX[i], RY[i], and RZ[i] when the input value (R, 0, 0) equals (Rp[i], 0, 0). By substituting the modified display components RXp[i], RYp[i], RZp[i], GXp[i], GYp[i], GZp[i], BXp[i], BYp[i], and BZp[i] as the display components RX, RY, RZ, GX, GY, GZ, BX, BY, and BZ in the equations eq1, eq2, eq3a, eq3b, eq4a, and eq4b, the color characteristic value CCT[i] corresponding to the modified input value (Rp[i], Gp[i], Bp[i]) may be obtained.

In Step 208, the color characteristic value CCT[i] corresponding to the modified input components Rp[i] and Bp[i] is compared with a target characteristic value CCTtarget to determine whether it matches a target characteristic value CCTtarget. The process 200 proceeds to Step 212 when a result is affirmative, or else Step 210 is performed.

In Step 210, the modified input component Rp[i] and/or Bp[i] is updated and Step 206 is iterated.

When the process 200 reaches Step 212, it infers that the color characteristic value CCT[i] corresponding to the modified input components Rp[i] and Bp[i] matches the target characteristic value CCT[i]. Therefore, in Step 212, the corresponding modified input components Rp[i] and Bp[i] of the predetermined candidate input component R, the predetermined candidate input component G, and the predetermined candidate input component R may be provided to the block L[i]. Furthermore, two modification differences dR[i] and dB[i] are calculated. The modification difference dR[i] is a difference between the modified input component Rp[i] and the input component R, and the modification difference dB[i] is a difference between the modified input component Bp[i] and the input component B.

The process 200 ends in Step 214.

The process 200 may be repeatedly performed for different blocks L[1] to L[Q], the input component R of different candidate values (e.g., 0 to (J-1)), the input component G of different candidate values, and the input component B of different candidate values. For example, the process 200 is performed for Q*J*J*J number of times to respectively provide J*J*J number of corresponding modified input values (Rp[i], Gp[i], Bp[i]) and modification differences (dR[i], dG[i], dB[i]) for the blocks L[1] to L[Q] with respect to J number of possible input component R, J number of possible input component G, and J number of possible input component B.

Before the process 200 begins, a target characteristic value CCTtarget may be determined. For example, to execute the process 200 for each of the blocks L[i] with respect to a predetermined input value (R, G, B), the initial color characteristic value CCT[i] may first be calculated according to the input value (R, Gp[i], B) for each of the blocks L[i], and the target characteristic value CCTtarget may be no greater than initial color characteristic values CCT[1] to CCT[Q] of the blocks L[1] to L[Q]. For example, the target characteristic value CCTtarget may equal to min(CCT[1], . . . , CCT[Q]), max(CCT[1], . . . , CCT[Q]) or mean(CCT[1], . . . , CCT[Q]).

FIG. 4 shows a schematic diagram of a display controller 22 (e.g., a control chip) for a control panel 14 according to an embodiment of the present invention. Results from adjustment operations of the modifying system 10, the process 100 and the process 200 on the panel 14 may be applied to the display controller 22 to enhance a uniformity of the panel. The display controller 22 comprises a modifying module 24 and a mapping circuit 12. The modifying module 24 records the modification differences dR[i], dG[i], and dB[i] corresponding to the candidate values of the input components R, G, and B for each of the blocks L[i]. For one block L[i], the corresponding modification differences dR[i] may vary with different values of the input component R. Similarly, the corresponding modification differences dG[i] may vary with different values of the input component G, and so forth. For different blocks L[i1] and L[i2], the corresponding modification differences dG[i1] and dG[i2] may also be different for same-valued input components R, G, and B, and so forth.

When the display controller 22 receives the input values (r[m, n], g[m, n], b[m, n]) of the pixels px[m, n] in a video stream from a signal source, the modifying module 24 provides corresponding modification differences dR[i], dG[i], and dB[i] according to the block L[i] where the pixels px[m, n] are located and the candidate values (R, G, B) corresponding to the input values (r[m, n], g[m, n], b[m, n]), so as to provide the modified input values (Rp[i], Gp[i], Bp[i]) (i.e., Rp[i]=r[m, n]+dR[i], Gp[i]=g[m, n]+dG[i], Bp[i]=b[m, n]+dB[i]). Through linear distribution or alpha-blending, the modified input values (Rp[i], Gp[i], Bp[i]) are distributed to the pixels, so as to obtain a plurality of modified pixel input values (Rpx[i], Bpx[i], Bpx[i]) in a unit of pixel to replace the original pixel values (r[m, n], g[m, n], b[m, n]) of the pixels px[m, n]. The mapping circuit 12 then enables each of the pixels px[m, n] to display colors according to the modified pixel input values (Rpx[i], Bpx[i], Bpx[i]).

In conclusion, it is illustrated in the above embodiments that the technique disclosed by present invention, targeted at achieving consistency on colors and characteristic values, modifies pixel input values according to blocks where the pixels are located, thereby enhancing a uniformity on color rendering of a panel and optimizing a yield rate of the panel.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for adjusting a uniformity of a panel, the panel comprising a plurality of blocks, each of the blocks associating a first input value to a corresponding display value via a measurement, the first input value comprising a first input component, the method comprising:

adjusting a brightness of the display value corresponding to each of the blocks to match a target brightness by accordingly providing a modified first input component corresponding to the first input component for each of the blocks;

each of the blocks associating a second input value to a corresponding color temperature value via the measurement, the second input value comprising the modified first input component; and adjusting the corresponding color temperature value of each of the blocks to match a target color temperature value by accordingly providing a corresponding modified second input component and a corresponding modified third input component for each of the blocks, so as to generate a corresponding modified display value according to the modified first input component, the modified second input component and the modified third input component.

2. The method according to claim 1, wherein the second input value comprises a second input component and a third input component, and each of the blocks associates the corresponding second input value to a modified color temperature value via the measurement; and the modified second input value corresponding to each of the blocks comprises the modified second input component and the modified third input component.

3. The method according to claim 1, further comprising:

updating the first input component corresponding to each of the blocks to provide a corresponding modified first input value, the first input component corresponding to each of the blocks being associated to the corresponding modified display value via the measurement; and comparing the brightness of the modified display value corresponding to each of the blocks with the target brightness to determine whether the main display component matches the target component.

4. The method according to claim 3, wherein the first input component is a green input component.

5. The method according to claim 1, further comprising:

updating at least one of the second input component and the third input component of the second input value corresponding to each of the blocks to provide a corresponding modified second input value, the modified second input value corresponding to each of the blocks being associated to a corresponding modified color temperature value via the measurement of each of the blocks; and comparing the modified color temperature value corresponding to each of the blocks with the target characteristic value to determine whether the modified color temperature value matches the target characteristic value.

6. The method according to claim 5, wherein the second input component is a red input component and the third input component is a blue input component.

7. The method according to claim 1, further comprising:

determining the target brightness according to the brightness of the display values corresponding to the blocks.

8. The method according to claim 1, further comprising:

determining the target brightness according to the brightness corresponding to the blocks, the target component being no greater than a maximum value of the main display components.

9. The method according to claim 8, wherein the target brightness equals a minimum value of the brightness.

10. The method according to claim 8, wherein the target brightness equals a maximum value or a mean value of the brightness.

11. The method according to claim 1, further comprising:

determining the target color temperature value according to the color temperature values corresponding to the blocks.

12. The method according to claim 11, wherein the target brightness equals a minimum value of the brightness.

13. The method according to claim 11, wherein the target brightness equals a maximum value or a mean value of the brightness.

14. A display controller for a panel, the panel comprising a plurality of blocks, each comprising a plurality of pixels, the display controller receiving corresponding input values of the pixels to associate each of the pixels to display a main display component, each of the input values being one of a plurality of candidate input values, the display controller comprising:

a modifying module, for providing a corresponding modified candidate input value for each of the blocks, a corresponding modified input value for each of the pixels according to the blocks where each of the pixels is located and the input value corresponding to each of the pixels, and a corresponding modified pixel input value for each of the pixels according to the modified input value; wherein, each of the modified candidate input value matches the main display components displayed by the blocks to one another; and a mapping circuit, for controlling the pixels to display colors according to the modified pixel input values;

wherein the modifying module provides the corresponding modified pixel input value according to the modified input value via alpha-blending processing.

15. The display controller according to claim 14, wherein the display of each of the pixels further associates with a color temperature value, the modified candidate input value corresponding to each of the blocks matches the color temperature values displayed by the blocks to one another.

16. The display controller according to claim 15, wherein the color characteristic values are associated with a color temperature.

17. The display controller according to claim 14, wherein the main display components represent brightness.

* * * * *